US010433051B2

(12) United States Patent
Usher

(10) Patent No.: US 10,433,051 B2
(45) Date of Patent: Oct. 1, 2019

(54) METHOD AND SYSTEM TO DETERMINE A SOUND SOURCE DIRECTION USING SMALL MICROPHONE ARRAYS

(71) Applicant: STATON TECHIYA, LLC, Delray Beach, FL (US)

(72) Inventor: John Usher, Devon (GB)

(73) Assignee: Staton Techiya, LLC, Delray Beach, FL (US)

( * ) Notice: Subject to any disclaimer, the term of this patent is extended or adjusted under 35 U.S.C. 154(b) by 0 days.

(21) Appl. No.: 15/607,649

(22) Filed: May 29, 2017

(65) Prior Publication Data

US 2018/0343517 A1 Nov. 29, 2018

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01); *H04R 2201/401* (2013.01)

(58) Field of Classification Search
None
See application file for complete search history.

(56) References Cited

U.S. PATENT DOCUMENTS 6,731,334 B1 * 5/2004 Maeng ..... G01S 3/7864 348/14.08
2003/0081504 A1 * 5/2003 McCaskill ..... G01S 3/8083 367/118
2008/0187152 A1 * 8/2008 Kim ..... G10L 21/0208 381/92
2010/0123770 A1 * 5/2010 Friel ..... H04N 7/15 348/14.08
2010/0142732 A1 * 6/2010 Craven ..... H04R 5/027 381/170
2012/0320143 A1 * 12/2012 Chu ..... H04N 7/15 348/14.08
2013/0142355 A1 * 6/2013 Isaac ..... H04R 3/005 381/92
2014/0330560 A1 * 11/2014 Venkatesha ..... G06F 21/32 704/235
2015/0146078 A1 * 5/2015 Aarrestad ..... H04N 5/23212 348/345

OTHER PUBLICATIONS

Patent Cooperation Treaty, "International Search Report and Written Opinion", issued in International Application No. PCT/US2018/034920, by U.S. Searching Authority, dated Jun. 28, 2018; document of 15 pages.

* cited by examiner

*Primary Examiner* — James K Mooney
(74) *Attorney, Agent, or Firm* — Akerman LLP; Peter A. Chiabotti; Mammen (Roy) P. Zachariah, Jr.

(57) ABSTRACT

Herein provided is a method and system to determine a sound source direction using a microphone array comprising at least four microphones by analysis of the complex coherence between at least two microphones. The method includes determining the relative angle of incidence of the sound source and communicating directional data to a secondary device, and adjusting at least one parameter of the device in view of the directional data. Other embodiments are disclosed.

21 Claims, 7 Drawing Sheets

100

100

200

300

METHOD TO DETERMINE DIRECTION

400

Method to determine edge status

Method to determine voice activity status

Method to direct phased-array beam-former

Method to determine source range and bearing using multiple sensor units.

METHOD AND SYSTEM TO DETERMINE A SOUND SOURCE DIRECTION USING SMALL MICROPHONE ARRAYS

FIELD

The present invention relates to audio enhancement with particular application to voice control of electronic devices.

BACKGROUND

Increasing the signal to noise ratio (SNR) of audio systems is generally motivated by a desire to increase the speech intelligibility in a noisy environment, for purposes of voice communications and machine-control via automatic speech recognition.

A common system to increase SNR is using directional enhancement systems, such as the "beam-forming" systems. Beamforming or "spatial filtering" is a signal processing technique used in sensor arrays for directional signal transmission or reception. This is achieved by combining elements in a phased array in such a way that signals at particular angles experience constructive interference while others experience destructive interference.

The improvement compared with omnidirectional reception is known as the receive gain. For beamforming applications with multiple microphones, the receive gain, measured as an improvement in SNR, is about 3 dB for every additional microphone, i.e. 3 dB improvement for 2 microphones, 6 dB for 3 microphones etc. This improvement occurs only at sound frequencies where the wavelength is above the spacing of the microphones.

The beamforming approaches are directed to arrays where the microphones are spaced wide with respect to one another. There is also a need for a method and device for directional enhancement of sound using small microphone arrays and to determine a source direction for beam former steering.

A new method is presented to determine a sound source direction relative to a small microphone array of at least and typically 4 closely spaced microphones, which improves on larger systems and systems that only work in a 2 D plane.

DETAILED DESCRIPTION

Figure 1:
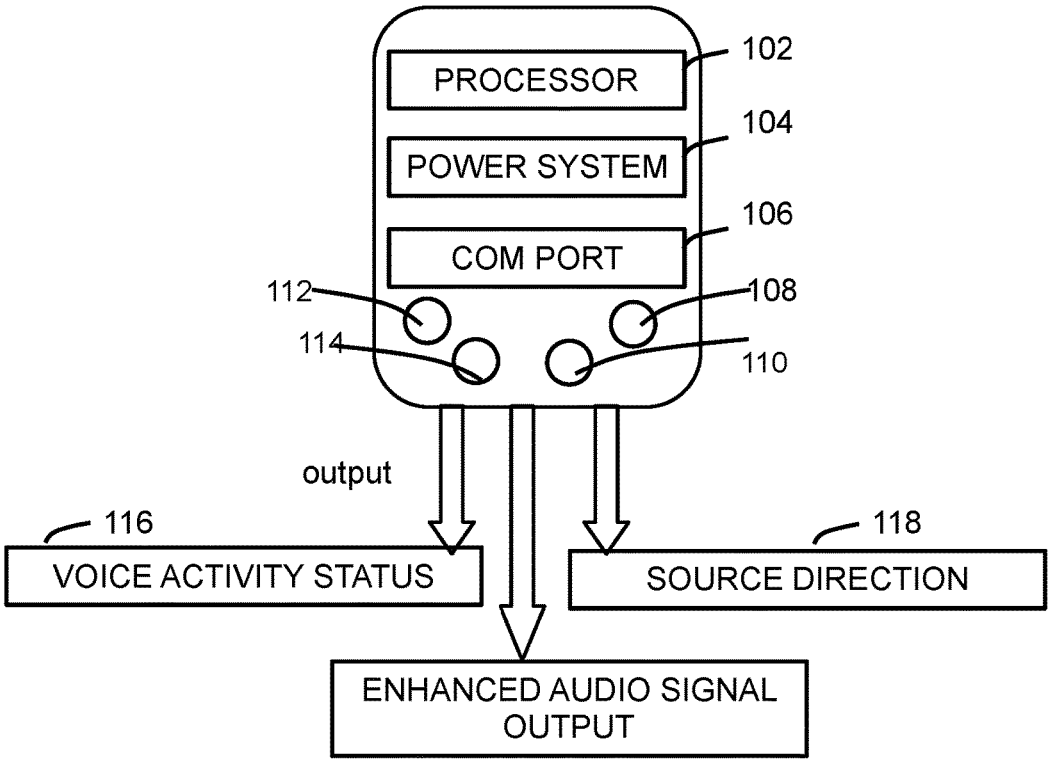
FIG. 1 illustrates an acoustic sensor in accordance with an exemplary embodiment.

The following description of at least one exemplary embodiment is merely illustrative in nature and is in no way intended to limit the invention, its application, or uses. Similar reference numerals and letters refer to similar items in the following figures, and thus once an item is defined in one figure, it may not be discussed for following figures.

Herein provided is a method and system for determine the source activity status and/or source direction in the presented embodiment of using four microphones configured in a regular tetrahedron, ie triangle-based pyramid. It overcomes the limitations experienced with conventional beamforming and source location finding approaches. Briefly, in order for a useful improvement in SNR, there must be many microphones (e.g. 3-6) spaced over a large volume (e.g. for SNR enhancement at 500 Hz, the inter-microphone spacing must be over half a meter).

FIG. 1 illustrates an acoustic sensor device in accordance with an exemplary embodiment;

The controller processor 102 can utilize computing technologies such as a microprocessor and/or digital signal processor (DSP) with associated storage memory such a Flash, ROM, RAM, SRAM, DRAM or other like technologies for controlling operations of the aforementioned components of the communication device.

The power supply 104 can utilize common power management technologies such as power from com port 106—such as USB, Firewire, Lightening connector, replaceable batteries, supply regulation technologies, and charging system technologies for supplying energy to the components of the communication device and to facilitate portable applications. In stationary applications, the power supply 104 can be modified so as to extract energy from a common wall outlet and thereby supply DC power to the components of the device 100.

The acoustic device 100 includes four microphones 108, 110, 112, 114. The microphones may be part of the device housing the acoustic device 100 or a separate device, and which is communicatively coupled to the acoustic device 100. For example, the microphones can be communicatively coupled to the processor 102 and reside on a secondary device that is one of a mobile device, a phone, an earpiece, a tablet, a laptop, a camera, a web cam, or a wearable accessory.

It should also be noted that the acoustic device 100 can also be coupled to other devices, for example, a security camera, for instance, to pan and focus on directional or localized sounds. Additional features and elements can be included with the acoustic device 100, for instance, communication port 106, to include communication functionality (wireless chip set, Bluetooth, Wi-Fi) to transmit at least one of the localization data, source activity status, and enhanced acoustic sound signals to other devices. In such a configuration, other devices in proximity or communicatively coupled can receive enhanced audio and directional data, for example, on request, responsive to an acoustic event at a predetermined location or region, a recognized keyword, or combination thereof.

As will be described ahead, the method implemented by way of the processor 102 performs the steps of calculating a complex coherence between all pairs of microphone signals, determining an edge status, determining a source direction.

The devices to which the output audio signal is directed can include but are not limited to at least one of the following: an "Internet of Things" (IoT) enabled device, such as a light switch or domestic appliance; a digital voice controlled assistant system (VCAS), such as a Google home device, Apple Siri-enabled device, Amazon Alexa device, IFTTT system; a loudspeaker; a telecommunications device; an audio recording system, a speech to text system, or an automatic speech recognition system.

The output audio signal can also be fed to another system, for example, a television for remote operation to perform a voice controlled action. In other arrangements, the voice signal can be directed to a remote control of the TV which may process the voice commands and direct a user input command, for example, to change a channel or make a selection. Similarly, the voice signal or the interpreted voice commands can be sent to any of the devices communicatively controlling the TV.

The voice controlled assistant system (VCAS) can also receive the source direction 118 from system 100. This can allow the VCAS to enable other devices based on the source direction, such as to enable illumination lights in specific rooms when the source direction 118 is co-located in that room. Alternatively, the source direction 118 can be used as a security feature, such as an anti-spoofing system, to only enable a feature (such as a voice controlled door opening system) when the source direction 118 is from a predetermined direction.

Likewise, the change in source direction 118 over time can be monitored to predict a source movement, and security features or other device control systems can be enabled when the change in source direction over time matches a predetermined source trajectory, eg such a system can be used to predict the speed or velocity of movement for the sound source.

An absolute sound source location can be determined using at least two for the four-microphone units, using standard triangulation principles from the intersection of the at least two determined directions.

Further, if the change in source direction 118 is greater than a predetermined angular amount within a predetermined time period, then this is indicative of multiple sounds sources, such as multiple talkers, and this can be used to determine the number of individuals speaking, ie for purposes of "speaker recognition" aka speaker diarization (i.e. recognizing who is speaking). The change in source direction can also be used to determine a frequency dependant or signal gain value related to local voice activity status—ie where the gain value is close to unity if local voice activity is detected, and the gain is 0 otherwise.

The processor 102 can further communicate directional data derived from the coherence based processing method with the four microphone signals to a secondary device, where the directional data includes at least a direction of a sound source, and adjusts at least one parameter of the device in view of the directional data. For instance, the processor can focus or pan a camera of the secondary device to the sound source as will be described ahead in specific embodiments. For example, the processor can perform an image stabilization and maintain a focused centering of the camera responsive to movement of the secondary device, and, if more than one camera is present and communicatively coupled thereto, selectively switch between one or more cameras of the secondary device responsive to detecting from the directional data whether a sound source is in view of the one or more cameras.

In another arrangement, the processor 102 can track a direction of a voice identified in the sound source, and from the tracking, adjusting a multi-microphone beam-forming system to direct the beam-former towards the direction of the sound source. The multi-microphone beam-forming system can include microphone of the four microphone system 100, but would typically include many more microphones spaced over at least 50 cm. In a typical embodiment, the multi-microphone beam-forming system would contain 5 microphones arranged in a line, spaced 15 cm to 20 cm apart (the spacing can be more or less than this in further embodiments).

The system of the current invention 100 presented herein is distinguished from related art such as U.S. Pat. No. 9,271,077 that uses at least 2 or 3 microphones, but does not disclose the 4 or more microphone array system of the present invention that determines the sound source direction in 3 dimensions rather than just a 2D plane. U.S. Pat. No. 9,271,077 describes a method to determine a source direction but is restricted to a front or back direction relative to the microphone pair. U.S. Pat. No. 9,271,077 does not disclose a method to determine a sound source direction using 4 microphones where the direction includes a precise azimuth and elevation direction.

The system 100 can be configured to be part of any suitable media or computing device. For example, the system may be housed in the computing device or may be coupled to the computing device. The computing device may include, without being limited to, wearable and/or body-borne (also referred to herein as bearable) computing devices. Examples of wearable/body-borne computing devices include head-mounted displays, earpieces, smart watches, smartphones, cochlear implants and artificial eyes. Briefly, wearable computing devices relate to devices that may be worn on the body. Wearable computing devices relate to devices that may be worn on the body or in the body, such as implantable devices. Bearable computing devices may be configured to be temporarily or permanently installed in the body. Wearable devices may be worn, for example, on or in clothing, watches, glasses, shoes, as well as any other suitable accessory.

The system 100 can also be deployed for use in non-wearable con-texts, for example, within cars equipped to take photos, that with the directional sound information captured herein and with location data, can track and identify where the car is, the occupants in the car, and the acoustic sounds from conversations in the vehicle, and interpreting what they are saying or intending, and in certain cases, predicting a destination. Consider photo equipped vehicles enabled with the acoustic device 100 to direct the camera to take photos at specific directions of the sound field, and secondly, to process and analyze the acoustic content for information and data mining. The acoustic device 100 can inform the camera where to pan and focus, and enhance audio emanating from a certain pre-specified direction, for example, to selectively only focus on male talkers, female talkers, or non-speech sounds such as noises or vehicle sounds.

In one embodiment where the device 100 operates in a landline environment, the comm port transceiver 106 can utilize common wire-line access technology to support POTS or VoIP services. In a wireless communications setting, the port 106 can utilize common technologies to support singly or in combination any number of wireless access technologies including without limitation Bluetooth™, Wireless Fidelity (WiFi), Worldwide Interoperability for Microwave Access (WiMAX), Ultra Wide Band (UWB), software defined radio (SDR), and cellular access technologies such as CDMA-1×, W-CDMA/HSDPA, GSM/GPRS, EDGE, TDMA/EDGE, and EVDO. SDR can be utilized for accessing a public or private communication spectrum according to any number of communication protocols that can be dynamically downloaded over-the-air to the communication device. It should be noted also that next generation wireless access technologies can be applied to the present disclosure.

The power system 104 can utilize common power management technologies such as power from USB, replaceable batteries, supply regulation technologies, and charging system technologies for supplying energy to the components of the communication device and to facilitate portable applications. In stationary applications, the power supply 104 can be modified so as to extract energy from a common wall outlet and thereby supply DC power to the components of the communication device 106.

Figure 2:
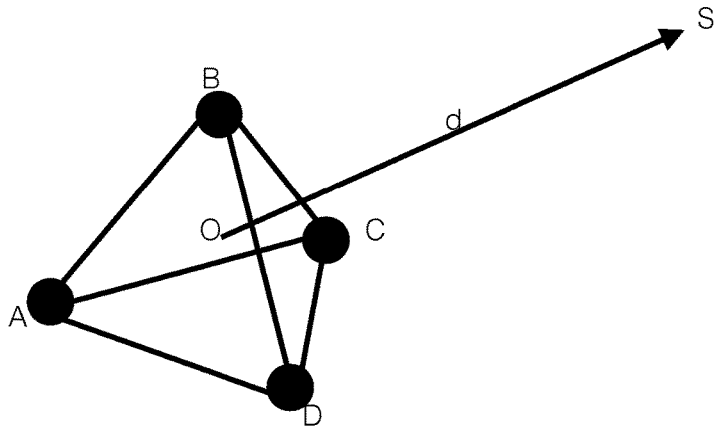
FIG. 2 illustrates a schematic configuration of the microphone system showing the notation used for 4 microphones A, B, C, D with edges AB, AC, AD, BC and CD.

Referring to FIG. 2, the system 100 shows an embodiment of the invention: four microphones A, B, C, D are located at vertices of a regular tetrahedron. We consider the location of these microphones as x,y,z vectors at location A, B, C, D, and the 6 edges between them (that will be used later) defined as AB, AC, AD, BC, BD, and CD. And we define the origin, i.e. centre, of the microphone array at location O (i.e. location 0,0,0).

For instance, we define microphone A at location x_A, y_A, z_A, and microphone B at location x_B, y_B, z_B, and edge AB is the vector x_B-x_A, y_B-y_A, z_B-z_A. We present in the present invention a method to determine the direction of source S from origin O, e.g. in terms of an azimuth and elevation.

We assume that the distance (d) to the source (S) is much greater than the distance between the microphones. In a preferred embodiment, the distance between microphones is between 10 and 20 mm, and the distance to the human speaking or other sound source is typically greater than 10 cm, and up to approximately 5 meters. (These distances are by way of example only, and may vary above or below the stated ranges in further embodiments.)

As will be shown, the source direction can be determined by knowing the edge vectors. As such, using four microphones we can have an irregular tetrahedron (ie inter microphone distances can be different).

Also, the present invention can be generalized for any number of microphones greater than 2, such as 6 arranged as a cuboid.

Figure 3:
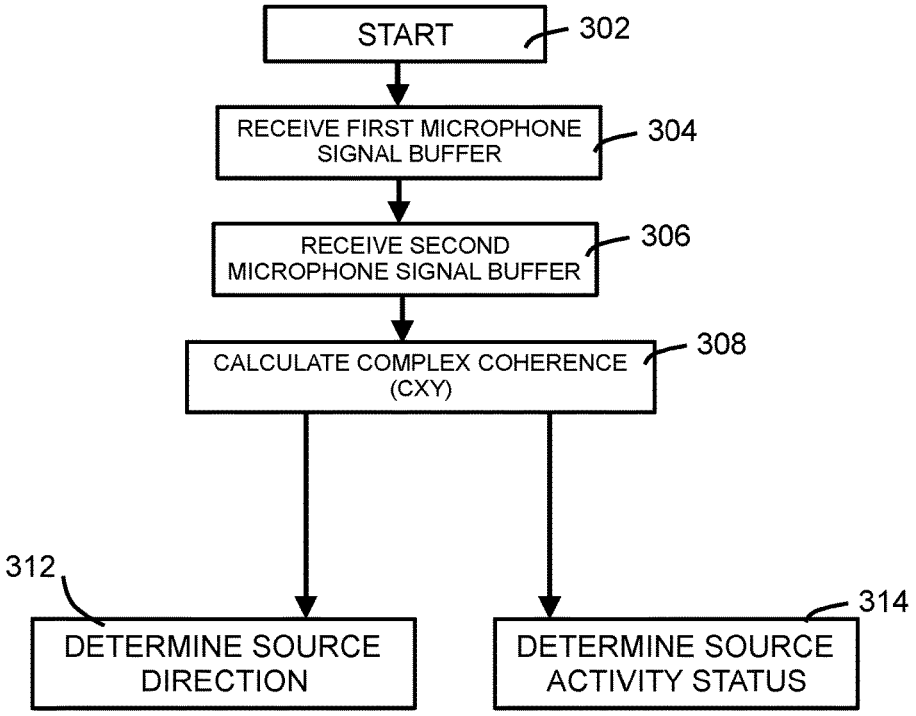
FIG. 3 is an overview of calculating an inter-microphone coherence and using this to determine source activity status and/or the source direction.

The FIG. 3 is a flowchart 300 showing of calculating an inter-microphone coherence and using this to determine source activity status and/or the source direction.

In steps 304 and 306, a first microphone and the second microphone capture a first signal and second signal.

A step 308 analyzes a coherence between the two microphone signals (we shall call these signals M1 and M2). M1 and M2 are two separate audio signals.

The complex coherence estimate, Cxy as determined is a function of the power spectral densities, Pxx(f) and Pyy(f), of x and y, and the cross power spectral density, Pxy(f), of two signals x and y. For instance, x may refer to signal M1 and y to signal M2.

$$C_{xy}(f) = \frac{P_{xy}^2}{P_{xx}(f)P_{yy}(f)}$$

$$P_{xy}(f) = \Im(M1).*conj(\Im(M2))$$

$$P_{xx}(f) = \text{abs}(\Im(M1)^2)$$

$$P_{yy}(f) = \text{abs}(\Im(M2)^2)$$

where $\Im$ = Fourier transform

The window length for the power spectral densities and cross power spectral density in the preferred embodiment are approximately 3 ms (~2 to 5 ms). The time-smoothing for updating the power spectral densities and cross power spectral density in the preferred embodiment is approximately 0.5 seconds (e.g. for the power spectral density level to increase from −60 dB to 0 dB) but may be lower to 0.2 ms.

The magnitude squared coherence estimate is a function of frequency with values between 0 and 1 that indicates how well x corresponds to y at each frequency. With regards to the present invention, the signals x and y correspond to the signals from a first and second microphone.

The average of the angular phase, or simply "phase" of the coherence Cxy angle is determined. Such a method is clear to one skilled in the art: the angular phase can be estimated as the phase angle between the real and imaginary parts of the complex coherence. In one exemplary embodiment, the average phase angle is calculated as the mean value between 150 Hz and 2 kHz (ie the frequency taps of the complex coherence that correspond to that range).

Based on an analysis of the phase of the coherence, we then determine a source direction 312 and/or a source activity status 314. The method to determine source direction and source activity status is described later in the present work, using an edge status value. The source direction is as previously defined, i.e. for the preferred embodiment in FIG. 2, this direction can be represented as the azimuth and elevation of source S relative to the microphone system origin. The source activity status is here defined as a binary value describing whether a sound source is detected in the local region to the microphone array system, where a status of 0 indicates no sound source activity, and a status of 1 indicates a sound source activity. Typically, the sound source would correspond to a spoken voice by at least 1 individual.

Figure 4A:
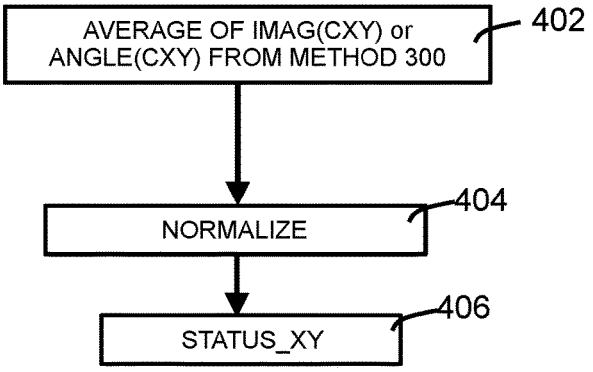
FIG. 4A illustrates a method for determining a edge status value for a microphone pair XY.

FIG. 4A illustrates a flowchart 400 showing a method for determining an edge status value for a microphone pair XY. The value is set based on an average value of the imaginary component of the coherence CXY (AV_IMAG_CXY) or an average value of the phase of the complex coherence (ie the phase angle between the real and imaginary part of the coherence) between a adjacent microphone pairs of microphone signal X and Y. In the preferred embodiment, AV_IMAG_CXY is based on an average of the coherence between approximately 150 Hz and 2 kHz (ie the taps in the CXY spectrum that correspond to this frequency range). An edge status value is generated for each of the edges, so for the embodiment of FIG. 2, there are 6 values. We generically refer to these values as STATUS_XY for an edge between vertices X and Y, so for the edge between microphones A and B this would be called STATUS_AB. In step 404, which in the preferred embodiment is done by dividing STATUS_XY by 0.1.

The method to generate an edge status between microphone vertices X and Y, STATUS_XY, can be summarized as comprising the following steps:

1. Determine AV_IMAG_CXY by averaging (i.e. taking the mean) of the phase of the complex coherence between microphones X and Y.

2. Normalizing the AV_IMAG_CXY, in the preferred embodiment by 0.1.

An intuitive explanation of the edge status values is positive, then a sound source exists closer to the first microphone in the pair (e.g. towards microphone A for STATUS_AB) than towards the second microphone; and if the edge status value is negative, the sound source is located closer to the second microphone (e.g. towards microphone B for STATUS_AB); and if the edge status value=0 (or close to 0), then the sound source is located approximately equidistant to both microphones, ie. close to an axis perpendicular to the A-B vector. Put another way, conceptually, the STATUS_XY (and therefor the weighted edge vector) value can be thought of as a value between −1 and 1 related to the direction of the sound source related to that pair of microphones X and Y. If the value is close to −1 or 1, then the sound source direction will be located in front or behind the microphone pair—i.e. along the same line as the 2 microphones. If the STATUS_XY value is close to 0, then the sound source is at a location approximately orthogonal (i.e. perpendicular and equidistant) to the microphone pair. The weighted edge vector value is directly related to the average phase angle of the coherence (e.g. the weighted edge vector value is a negative value when the average phase angle of the coherence is negative).

In another embodiment, STATUS_XY is a vector for each frequency component (eg spectrum tap) of the phase of the complex coherence between a microphone pair X and Y, rather than a single value based on the average of the phase of the complex coherence.

With this alternate method, a frequency dependent source direction (i.e. azimuth and elevation) is estimated, i.e. for each of the frequency taps used to calculate the coherence between a microphone pair.

Figure 4B:
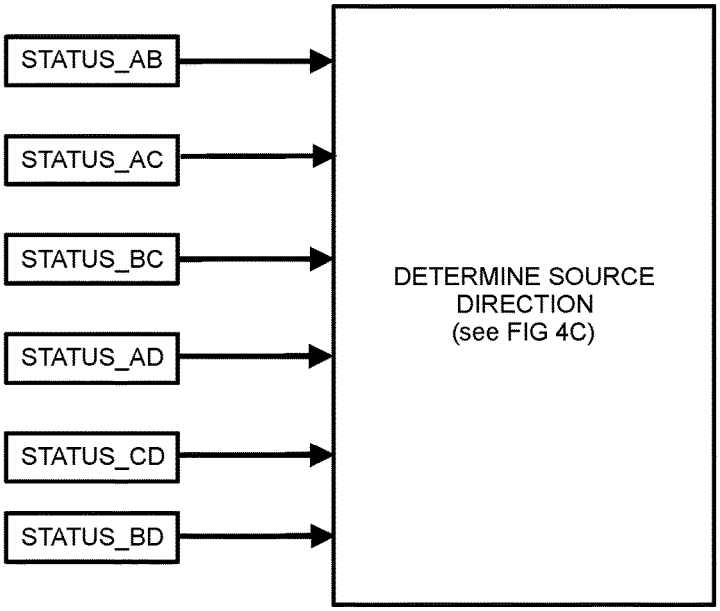
FIG. 4B illustrates a schematic overview to determine source direction from the 6 edge status values. The mathematical process is described in FIG. 4C and FIG. 4D.

FIG. 4B illustrates a schematic overview to determine source direction from the 6 edge status values. The mathematical process is described further in the FIGS. 4C and 4D.

Figure 4C:
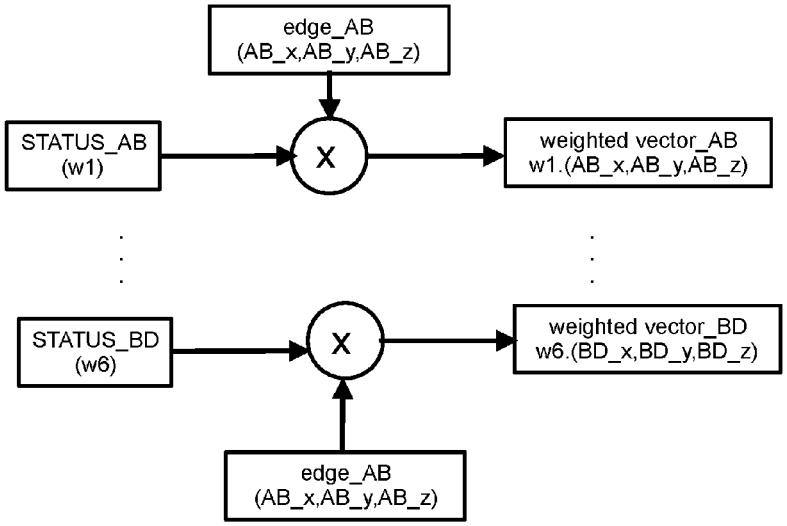
FIG. 4C illustrates a method to determine a set of weighted edge vectors for the preferred invention configuration of FIG. 2, given 6 edge status value weights w1, w2, w3, w4, w5, w6 (where w1 is STATUS_AB, w2 is STATUS_AC, w3 is STATUS_AD, w4 is STATUS_BC, w5 is STATUS_BD, w6 is STATUS_CD) and 6 edge vectors AB, AC, AD, BC, BD, CD. For the sake of brevity, we only show the multiplication of two weights and two vectors.

FIG. 4C illustrates a method to determine a set of weighted edge vectors for the embodiment of FIG. 2, given 6 edge status value weights w1, w2, w3, w4, w5, w6 (where w1 is STATUS_AB, w2 is STATUS_AC, w3 is STATUS_AD, w4 is STATUS_BC, w5 is STATUS_BD, w6 is STATUS_CD) and 6 edge vectors AB, AC, AD, BC, BD, CD. The edge vector is defined by 3 x,y,z values. E.G. for edge_AB, this is the vector between the location of microphones A and B, as shown in FIG. 2 (where the vector of the edge between two microphones at points A(x1,y1,z1) and B(x2,y2,z2) is defined as edge_AB(x2−x1,y2−y1,z2−z1).

For the sake of brevity, in FIG. 4C we only show the multiplication of two weights and two vectors. The same multiplication functions would be per-formed on the other weights and vectors (the 'x' symbol in the circle represents a multiplication operation).

Figure 4D:
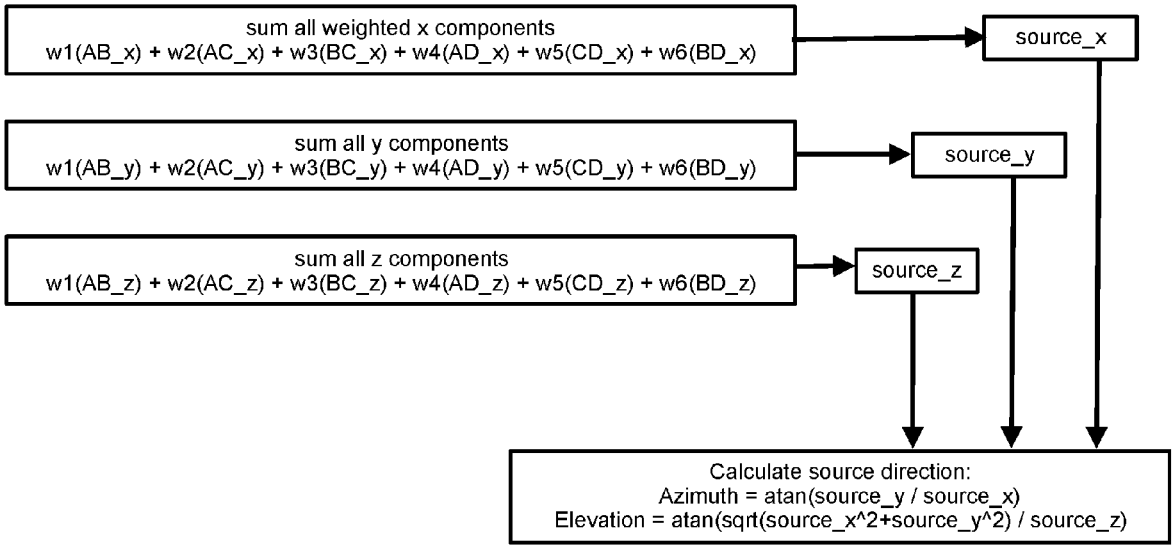
FIG. 4D illustrates a method for determining a sound source direction given the weighted edge vectors determined via the method in FIG. 4C.

FIG. 4D illustrates a method for determining a sound source direction given the weighted edge vectors determined via the method in FIG. 4C.

For the 4 microphone configuration of FIG. 2, this method comprises the following steps:

1. sum all weighted x components (ie the location of each microphone in the x axis), with each of the 6 weight values:

$$source_x = w1(AB_x) + w2(AC_x) + w3(BC_x) + w4(AD_x) + w5(CD_x) + w6(BD_x)$$

2. sum all weighted y components (ie the location of each microphone in the y axis), with each of the 6 weight values:

$$source_y = w1(AB_y) + w2(AC_y) + w3(BC_y) + w4(AD_y) + w5(CD_y) + w6(BD_y)$$

3. sum all weighted z components (ie the location of each microphone in the x axis), with each of the 6 weight values:

$$source_z = w1(AB_z) + w2(AC_z) + w3(BC_z) + w4(AD_z) + w5(CD_z) + w6(BD_z)$$

4. Calculate (estimate) the sound source direction using the values from above steps 1-3:

$$Azimuth = a\ tan(source_y / source_x)$$

$$Elevation = a\ tan(sqrt(source_x^2 + source_y^2) / source_z)$$

Figure 5:
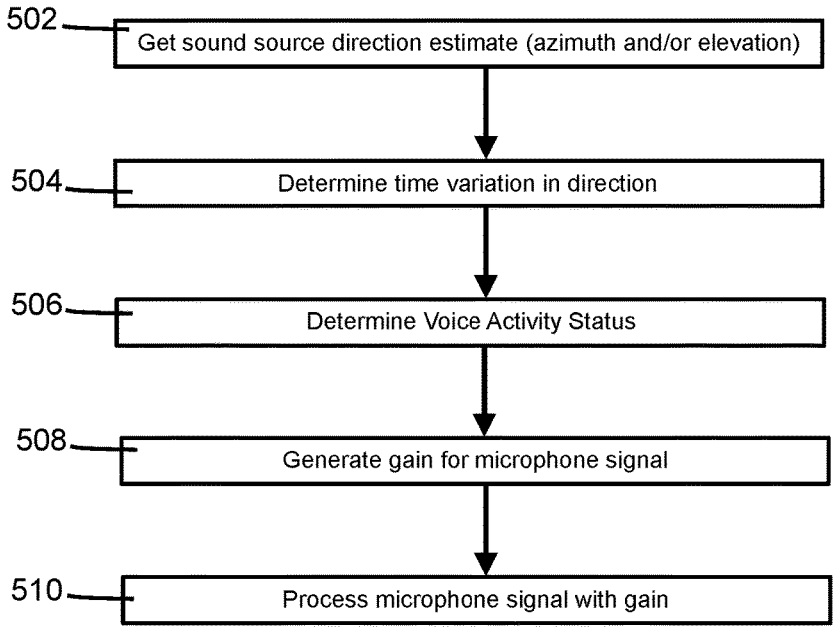
FIG. 5 illustrates a method for determining a sound source or voice activity status.

FIG. 5 illustrates a method for determining a sound source or Voice Activity Status, which we shall call a VAS for brevity.

In the preferred embodiment, the VAS is set to 1 if we determine that there is sound source with an azimuth and elevation close to a target azimuth and elevation (e.g. within 20 degrees of the target azimuth and elevation), and 0 otherwise.

In this embodiment, the VAD is directed to an electronic device and the electronic device is activated if the VAS is equal to 1 and deactivated otherwise. Such an electronic device can be a light switch, or a medical or security device.

In a further embodiment, the VAS is a frequency dependent vector, with values equal to 1 or 0.

The VAS single value or frequency dependent value is a gain value applied to a microphone signal, which in the preferred embodiment is the center microphone B in FIG. 2 (it is the center microphone if the pyramid shape is viewed from above).

In the preferred embodiments, the single or frequency dependent VAS value or values are time-smoothed so that they do not change value rapidly, as such the VAS is converted to a time-smoothed VAS value that has a continuous possible range of values between 0.0 and 1.0.

In an exemplary embodiment to determine a VAS, we use the sound source direction estimate 502 (for example, determined as described previously above) and the time variation in the sound source direction estimate is determined in step 504. In practice, this variation can be estimated as the angle fluctuation e.g. in degrees per second.

A VAS is determined in step 506 based on the time variation value from step 504. In the preferred embodiment, the VAS is set to 1 if the variation value is below a predetermined threshold, equal to approximately 5 degrees per second.

From the VAS in step in step 506, a microphone gain value is determined. As discussed, In the preferred embodiment the single or frequency dependant VAS value or values are time-smoothed to generate a microphone gain. As such the VAS is converted to a time-smoothed VAS value that has a continuous possible range of values between 0.0 and 1.0.

In step 510 the microphone gain is applied to a microphone signal, which in the embodiments is the central microphone B in FIG. 2.

Figure 6:
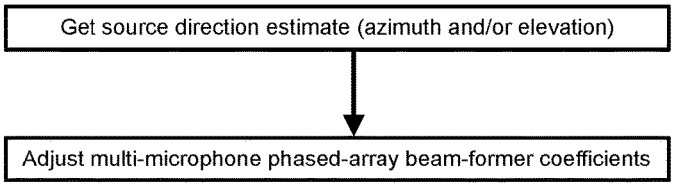
FIG. 6 illustrates a configuration of the present invention used with a phased-array microphone beam-former.

FIG. 6 illustrates a configuration of the present invention used with a phased-array microphone beam-former. Such a configuration is a standard use of a sound source direction system. The determined source direction can be used by a beam-forming system, such as the well known Frost beam former algorithm.

Figure 7:
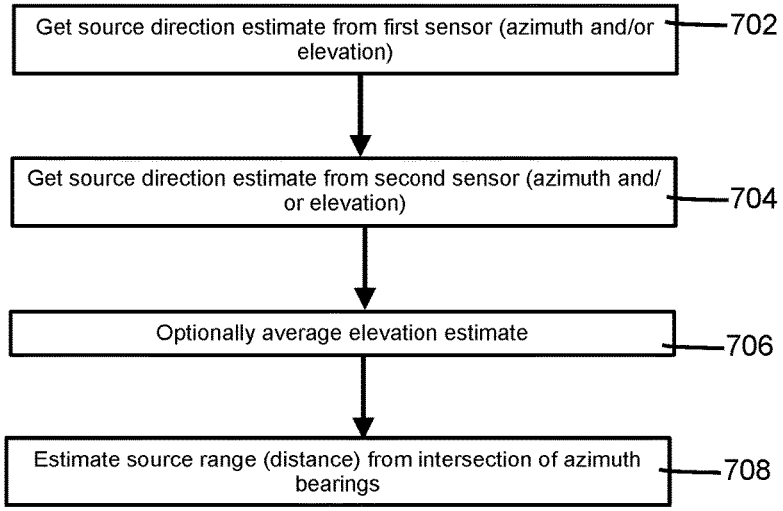
FIG. 7 illustrates a configuration of the present invention to determine range and bearing of a sound source using multiple sensor units.

FIG. 7 illustrates a configuration of the microphone array system of the present invention in conjunction with at least one further microphone array system. The configuration enables a sound source direction and range (i.e. distance) to be determined using standard triangulation principles. Because of errors in determining the sound source direction (e.g. due to sound reflections in the room, or other noise sources), then we can optionally ignore the estimated elevation estimate, and just use the 2 or more direction estimates from each microphone system to the sound source, and estimate the source distance from the point of intersection of the two direction estimates. In step 702, we receive a source direction estimate for a first sensor, where the direction estimate corresponds to an estimate of the azimuth and optionally the elevation of the sound source. In step 704, we receive a source direction estimate for a second sensor, again, where the direction estimate corresponds to an estimate of the azimuth and optionally the elevation of the sound source. In step 706, we optionally average the received first and second source elevation estimates. And in step 708, using standard triangulation techniques, the source range (i.e. distance) is estimated by the intersection of the first and second source azimuths estimates.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown.

Where applicable, the present embodiments of the invention can be realized in hardware, software or a combination of hardware and software. Any kind of computer system or other apparatus adapted for carrying out the methods described herein are suitable. A typical combination of hardware and software can be a mobile communications device or portable device with a computer program that, when being loaded and executed, can control the mobile communications device such that it carries out the methods described herein. Portions of the present method and system may also be embedded in a computer program product, which comprises all the features enabling the implementation of the methods described herein and which when loaded in a computer system, is able to carry out these methods.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

It should be noted that the system configuration 200 has many embodiments. Examples of electronic devices that incorporate multiple microphones for voice communications and audio recording or analysis, are listed a. Smart watches.
b. Smart "eye wear" glasses.
c. Remote control units for home entertainment systems.
d. Mobile Phones.
e. Hearing Aids.
f. Steering wheel.
g. Light switches.
h. IoT enabled devices, such as domestic appliances e.g. refrigerators, cook-ers, toasters.
i. Mobile robotic devices.

These are but a few examples of embodiments and modifications that can be applied to the present disclosure without departing from the scope of the claims stated below. Accordingly, the reader is directed to the claims section for a fuller understanding of the breadth and scope of the present disclosure.

What is claimed is:

1. A method, practiced by way of a processor, to determine the direction of a sound source near a multi-microphone array comprising the steps of:

capturing at least 4 microphone signals of a microphone array;

calculating a complex coherence between all microphone signal pairs;

determining an edge value for each microphone signal pair using an aspect of the complex coherence, wherein the aspect of the complex coherence is a phase angle of the complex coherence;

estimating, by utilizing the edge value, a sound source direction relative to the microphone array; and transmitting, to a device, a signal including the sound source direction relative to the microphone array, wherein a parameter of the device is adjusted based on sound source direction included in the signal.

2. The method of claim 1, wherein the phase angle is estimated between real and imaginary parts of the complex coherence.

3. The method of claim 1, wherein the microphones in the microphone array are spaced between 10 mm and 20 mm apart.

4. The method of claim 1 wherein the microphone array comprises 4 microphones arranged as a regular polyhedron, wherein the regular polyhedron is a triangle-based pyramid.

5. A method, practiced by way of a processor, to determine the direction of a sound source near a multi-microphone array comprising the steps of:

capturing at least 4 microphone signals of a microphone array;

calculating a complex coherence between all microphone signal pairs;

determining an edge value for each microphone signal pair using an aspect of the complex coherence, wherein the aspect of the complex coherence is an imaginary part of the complex coherence;

estimating, by utilizing the edge value, a sound source direction relative to the microphone array; and transmitting, to a device, a signal including the sound source direction relative to the microphone array, wherein a parameter of the device is adjusted based on sound source direction included in the signal.

6. A method, practiced by way of a processor, to determine the direction of a sound source near a multi-microphone array comprising the steps of:

capturing at least 4 microphone signals of a microphone array;

calculating a complex coherence between all microphone signal pairs;

determining an edge value for each microphone signal pair using an aspect of the complex coherence, wherein the edge value is represented by STATUS_XY, and wherein the step of determining the edge value for each microphone signal pair includes the steps of:

1. Determining AV_IMAG_CXY by averaging of an aspect of the complex coherence between microphones X and Y, wherein the averaging comprises taking a mean of the aspect of the complex coherence between the microphones X and Y, wherein AV_IMAG_CXY is an average value of an imaginary component of the complex coherence.
2. Comparing AV_IMAG_CXY to a threshold value T
3. and based on the comparison of step 2, setting the STATUS_XY to:

a. If AV_IMAG_CXY<−T then STATUS_XY=−1.

b. If −T<AV_IMAG_CXY<T then STATUS_XY=0.

c. If AV_IMAG_CXY>T then STATUS_XY=1, and estimating, by utilizing the edge value, a sound source direction relative to the microphone array; and transmitting, to a device, a signal including the sound source direction relative to the microphone array, wherein a parameter of the device is adjusted based on sound source direction included in the signal.

7. The method of claim 6, wherein the STATUS_XY edge status value is frequency dependent.

8. A method, practiced by way of a processor, to determine the direction of a sound source near a multi-microphone array comprising the steps of:

capturing at least 4 microphone signals of a microphone array;

calculating a complex coherence between all microphone signal pairs;

determining an edge value for each microphone signal pair using an aspect of the complex coherence, wherein the edge value is represented by STATUS_XY, and wherein the step of determining the edge value for each microphone signal pair includes the steps of:

1. Determining AV_IMAG_CXY by averaging of an aspect of the complex coherence between microphones X and Y, wherein the averaging comprises taking a mean of the aspect of the complex coherence between the microphones X and Y, wherein AV_IMAG_CXY is an average value of an imaginary component of the complex coherence;
2. setting the STATUS_XY to any value between −1 and 1.0, where STATUS_XY=c/AV_IMAG_CXY, where c is a scalar value; and estimating, by utilizing the edge value, a sound source direction relative to the microphone array; and transmitting, to a device, a signal including the sound source direction relative to the microphone array, wherein a parameter of the device is adjusted based on sound source direction included in the signal.

9. A method, practiced by way of a processor, to determine the direction of a sound source near a multi-microphone array comprising the steps of:

capturing at least 4 microphone signals of a microphone array;

calculating a complex coherence between all microphone signal pairs;

determining an edge value for each microphone signal pair using an aspect of the complex coherence;

estimating, by utilizing the edge value, a sound source direction relative to the microphone array, wherein the step of estimating the sound source direction relative to the microphone array comprises the steps:

1. estimating the location of the source on the x, y, or z axis, and calculating an element by element sum of the product of the x, y or z axis component of each microphone pair edge vector, with the edge value;
2. calculating a vector from a location within the microphone array to the estimated x, y, z location of the sound source, and transmitting, to a device, a signal including the sound source direction relative to the microphone array, wherein a parameter of the device is adjusted based on sound source direction included in the signal.

10. The method of claim 9 wherein the sound source direction is frequency dependent.

11. A method, practiced by way of a processor, to determine a voice activity status (VAS) proximal to a microphone array comprising the steps of:

1. capturing at least 4 microphone signals of a microphone array;
2. estimating the direction of a sound source at a given time instance;
3. determining a time variation in the sound source direction, wherein the variation is determined as an angle fluctuation expressed in degrees per second;
4. determining a VAS based on the time variation value from step 3, wherein the VAS is set to 1 if the time variation is below a predetermined threshold that is equal to 5 degrees per second, wherein a microphone gain value is determined based on the VAS, and wherein the method further comprises generating the microphone gain based on the VAS, and the VAS is converted to a time-smoothed VAS value that has a continuous possible range of values between 0.0 and 1.0; and
5. transmitting, to a device, a signal including the direction of the sound source and the VAS, wherein a parameter of the device is adjusted based on the direction of the sound source included in the signal.

12. The method of claim 11, further comprising determining a complex coherence between microphone signal pairs of the at least 4 microphone signals of the microphone array.

13. The method of claim 11, wherein the microphones in the microphone array are spaced between 10 mm and 20 mm apart.

14. The method of claim 11 wherein the microphone array comprises 4 microphones arranged as a regular polyhedron.

15. A method, practiced by way of a processor, to determine a voice activity status (VAS) proximal to a microphone array comprising the steps of:

1. capturing at least 4 microphone signals of a microphone array;
2. estimating the direction of a sound source at a given time instance;
3. determining a time variation in the sound source direction, wherein the variation is determined as an angle fluctuation expressed in degrees per second;
4. determining a VAS based on the time variation value from step 3, wherein the VAS is set to 1 if the time variation is below a predetermined threshold that is equal to 5 degrees per second, wherein a microphone gain value is determined based on the VAS, and wherein the method further comprises generating the microphone gain based on the VAS, and the VAS is converted to a time-smoothed VAS value that has a continuous possible range of values between 0.0 and 1.0, wherein the generated microphone gain is applied to at least one of the at least 4 microphone signals; and 5. transmitting, to a device, a signal including the direction of the sound source and the VAS, wherein a parameter of the device is adjusted based on the direction of the sound source included in the signal.

16. A method, practiced by way of a processor, to determine a voice activity status (VAS) proximal to a microphone array comprising the steps of:

1. capturing at least 4 microphone signals of a microphone array;
2. estimating the direction of a sound source at a given time instance;
3. determining a time variation in the sound source direction, wherein the variation is determined as an angle fluctuation expressed in degrees per second;
4. determining a VAS based on the time variation value from step 3, wherein the VAS is set to 1 if the time variation is below a predetermined threshold that is equal to 5 degrees per second, wherein the VAS and a corresponding microphone gain value are frequency dependent; and
5. transmitting, to a device, a signal including the direction of the sound source and the VAS, wherein a parameter of the device is adjusted based on the direction of the sound source included in the signal.

17. A system, comprising:

a microphone array including microphones; and a processor that performs operations comprising:

capturing at least 4 microphone signals of a microphone array;

calculating a complex coherence between all microphone signal pairs;

determining an edge value for each microphone signal pair using an aspect of the complex coherence, wherein the aspect of the complex coherence is a phase angle of the complex coherence;

estimating, by utilizing the edge value, a sound source direction relative to the microphone array; and transmitting, to a device, a signal including the sound source direction relative to the microphone array, wherein a parameter of the device is adjusted based on sound source direction included in the signal.

18. The method of claim 17, wherein the microphones in the microphone array are spaced between 10 mm and 20 mm apart.

19. The method of claim 17 wherein the microphone array comprises 4 microphones arranged as a regular polyhedron.

20. The method of claim 17 wherein the operations further comprise activating a device if a voice activity status is equal to 1, and wherein the operations further comprise deactivating the electronic device if the voice activity status is not equal to 1.

21. The method of claim 20 wherein the device is at least one of a light switch, an audio reproduction device, a medical device or a security device.

* * * * *